US010950998B2

(12) United States Patent
Lybrand

(10) Patent No.: US 10,950,998 B2
(45) Date of Patent: Mar. 16, 2021

(54) WIRE GUIDE FOR INSULATION DISPLACEMENT CONTACT (IDC)

(71) Applicant: AVX Corporation, Fountain Inn, SC (US)

(72) Inventor: Brent Lybrand, Fountain Inn, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/806,075

(22) Filed: Mar. 2, 2020

(65) Prior Publication Data

US 2020/0295518 A1 Sep. 17, 2020

Related U.S. Application Data

(60) Provisional application No. 62/816,312, filed on Mar. 11, 2019.

(51) Int. Cl.

| | |
|---|---|
| ***H01R 43/01*** | (2006.01) |
| ***H01B 17/58*** | (2006.01) |
| ***H01R 4/2429*** | (2018.01) |

(52) U.S. Cl.

CPC ..... *H01R 43/01* (2013.01); *H01B 17/58* (2013.01); *H01R 4/2429* (2013.01)

(58) Field of Classification Search

CPC .... H01R 43/01; H01R 4/2429; H01R 13/514; H01B 17/58

See application file for complete search history.

(56) References Cited

U.S. PATENT DOCUMENTS

| | | | | |
|---|---|---|---|---|
| 5,417,581 | A | 5/1995 | Dechelette et al. | |
| 8,262,405 | B1 * | 9/2012 | Bishop | H01R 4/4836 439/439 |
| 10,594,051 | B2 * | 3/2020 | Zhang | H01R 13/5208 |
| 2002/0137403 | A1 * | 9/2002 | Morita | H01R 4/184 439/752 |

(Continued)

FOREIGN PATENT DOCUMENTS

| | | |
|---|---|---|
| CN | 208045763 | 11/2018 |
| JP | 2015-072815 | 4/2015 |

OTHER PUBLICATIONS

International Search Report in PCT/IB2020/052026 dated Jun. 26, 2020 (11 pages).

*Primary Examiner* — Abdullah A Riyami
*Assistant Examiner* — Nader J Alhawamdeh
(74) *Attorney, Agent, or Firm* — Foley & Lardner LLP

(57) ABSTRACT

This disclosure provides a method and apparatus for connecting insulated wires to electrical components. More specifically, an apparatus that includes a wire guide designed to assist with the alignment of wires prior to termination of the wires to electrical components is disclosed. In an embodiment, the wire guide includes a body portion and a latching portion. The body portion includes at least one wire opening and is configured to mechanically secure one or more insulated wires in a desirable position. The latching portion is configured to secure the wire guide to a corresponding device such as an insulation displacement contact connector. A wire guide allows for insulated wires to be quickly and reliably positioned and secured relative to one another in order to safely and efficiently electrically and mechanically connect each insulated wire to a corresponding electrical component.

17 Claims, 6 Drawing Sheets

(56) References Cited

U.S. PATENT DOCUMENTS

| | | | | |
|---|---|---|---|---|
| 2012/0238154 | A1* | 9/2012 | Bishop | H01R 4/4845<br>439/709 |
| 2015/0171554 | A1* | 6/2015 | Beltzer | H01R 13/10<br>439/680 |
| 2018/0287277 | A1 | 10/2018 | Lybrand et al. | |
| 2020/0295518 | A1* | 9/2020 | Lybrand | H01R 43/01 |

* cited by examiner

WIRE GUIDE FOR INSULATION DISPLACEMENT CONTACT (IDC)

CROSS-REFERENCE TO RELATED APPLICATIONS

This application claims priority to U.S. Provisional Patent Application No. 62/816,312, filed Mar. 11, 2019, the entire disclosure of which is incorporated herein by reference in its entirety, for any and all purposes.

FIELD

The present application relates generally to the field of electrical connectors, and more particularly to a connector including an electrical connector and a wire guide that facilitates positioning of an insulated wire relative to the electrical connector.

BACKGROUND

The following description is provided to assist the understanding of the reader. None of the information provided or references cited are admitted to be prior art.

Various types of connectors are used for forming connections between an insulated wire and any manner of electronic or electrical component. These connectors are typically available as sockets, plugs, and shrouded headers in a vast range of sizes, pitches, and plating options. Traditionally, for a user to mechanically and electrically connect one or more wires to another electrical component such as an insulation displacement contact (IDC) connector the user must handle the one or more wires simultaneously in order to ensure all of the wires are correctly positioned before terminating the one or more wires. This process can be tedious, inefficient, and undesirable. Moreover, a wire-to-component connection that may fall apart or short out unexpectedly due to incorrect placement during assembly could be hazardous or expensive, especially when connecting the wires to an expensive component (e.g., a printed circuit board (PCB)). Thus, a quick, efficient, and reliable means of positioning a variety of sizes of wires in a variety of applications is needed.

SUMMARY

The systems, methods and devices of this disclosure each have several innovative aspects, no single one of which is solely responsible for the desirable attributes disclosed herein.

A wire guide is disclosed. The wire guide includes a latching portion and a body portion. The latching portion includes a first latching prong. In an embodiment, the latching portion also includes a second latching prong. The body portion includes at least one wire opening. The at least one wire opening extends entirely through the body portion from a rear surface to a front surface of the body portion. The at least one wire opening may include retention ribs that extend from the outer rim of the at least one wire opening toward a centerline axis of the at least one wire opening. Additionally, the retention ribs may extend from the front surface toward the rear surface. The at least one wire opening may be circularly shaped with a diameter that is consistent as it extends from the front surface to the rear surface. The at least one wire opening may also have a bevel that transitions the diameter of the at least one wire opening to the rear surface.

The body portion may be a solid piece of material that extends from the front surface to the rear surface, from a top surface to a bottom surface, and from a first surface to a second surface. The first latching prong may extend from the first surface toward and past the front surface to a first prong distal end. The second latching prong may extend from the second surface toward and past the front surface to a second prong distal end. In an embodiment, the at least one wire opening, the first latching prong, and the second latching prong extend along respective axes that are substantially parallel. Further, the top surface may be symmetrical to bottom surface. Similarly, the first side and first latching prong may be symmetrical to the second side and second latching prong. The first latching prong may also include a first-prong knob that extends from the first prong distal end toward the second latching prong. Similarly, the second latching prong may also include a second-prong knob that extends from the second-prong distal end toward the first latching prong. The front surface extends along a front plane and the rear surface extends along a rear plane, the front and rear planes may be parallel.

The wire guide may be used with an insulation displacement contact connecter that includes a housing cap and at least one electrical contact. The housing cap includes a wire alignment opening, an electrical contact opening, and a latch-receiving portion. The electrical contact includes an insulation displacement contact portion and a base portion. The wire alignment opening and the electrical contact opening perpendicularly intersect at an intersection within the housing cap. The latch-receiving portion may include a notch on a first side of the housing cap and a second notch on a second side of the housing cap. The first side is opposite of the second side on the housing cap.

In an operation, a first insulated wire is inserted into a first wire opening of the at least one wire openings and the first insulated wire is extended entirely through the body portion. The retention ribs center and mechanically secure the first wire within the insulated housing. In an embodiment, the operation may be repeated for however many insulated wires are being terminated in a given application. The front surface of the wire guide is then aligned with the housing cap. The front surface and protruding wires are then joined to the housing cap. That is, the first wire enters a first wire alignment opening of the housing cap and the latching portion mechanically secures to the latch-receiving portion. The electrical contact may then be compressed into electrical contact opening in order to mechanically and electrically connect the first insulated wire to the electrical contact.

The wire guide is not limited by its number of wire openings or other components. Particular embodiments of insulation displacement connectors are described in greater detail below by reference to the examples illustrated in the various drawings.

DETAILED DESCRIPTION

Figure 1:
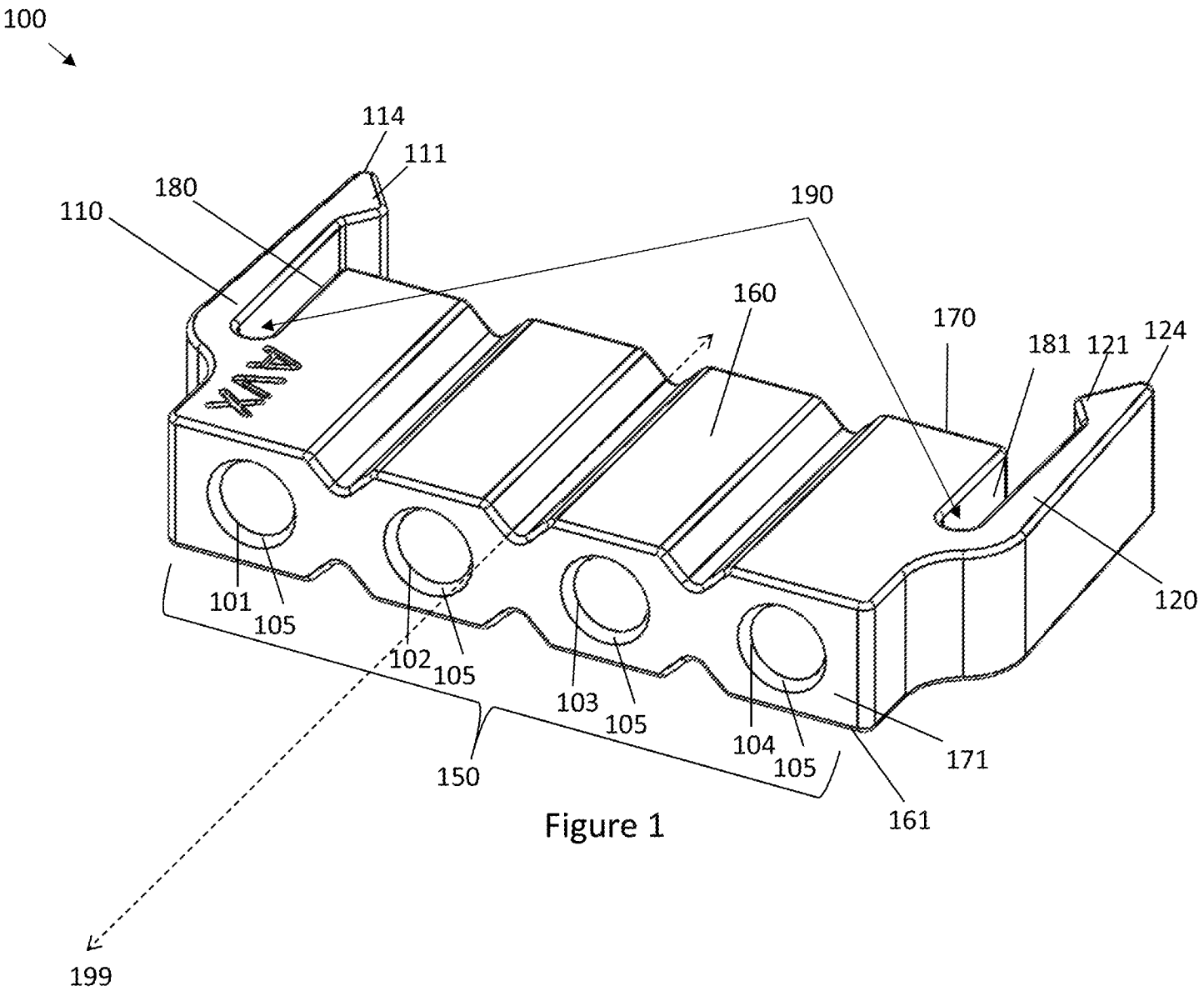
FIG. 1 depicts an isometric view of a wire guide in accordance with an illustrative embodiment.

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a wire guide that facilitates the alignment and positioning of wires with respect to a corresponding electrical connector. The wire guide can be used with a variety of electrical connectors. In an example embodiment, the wire guide is used with an insulation displacement contact connecter. The wire guide includes a body portion that receives one or more wires and a latching portion that mechanically secures the wire guide to the corresponding electrical connector. The body portion includes at least one wire opening that extends entirely through the body portion. In an example embodiment, the body portion includes multiple wire openings. Such a wire guide may be used to efficiently and reliably mechanically and electrically couple one or more wires to an electrical contact in a corresponding electrical connector. Specifically, the wire guide allows for discrete wires to be placed and held securely in position prior to inserting the wires into a corresponding electrical component (e.g., an insulation displacement contact). The wire guide assists in positioning and termination of such wires with an electrical contact. The unique design of the wire guide disclosed herein ensures that one or more wires can be efficiently, safely, and reliably staged before each of the wires are electrically connected to a sensitive or live electrical component. Specifically, the unique design of the wire guide is particularly useful with small wires in small products including the termination of a plurality of wires to a printed circuit board. Traditionally, a user must manually handle each wire and position each wire so that each wire can be terminated to the correct component. This method has proved to be cumbersome and inefficient. However, the design of this wire guide facilitates a more efficient and reliable manner of connecting such wires.

Various embodiments of a wire guide and corresponding electrical connectors are illustrated throughout FIGS. 1 through 6. The wire guide disclosed in these figures is configured to assist in the mechanical positioning of one or more wires within a corresponding electrical connector. In an embodiment, the wire guide may assist in the mechanical positioning of to one, two, three, or more wires. Furthermore, the wire guide may be used with any type of electrical connector including, but not limited to, an insulation displacement contact (IDC) connector mounted to a printed circuit board (PCB). It should be appreciated that the wire guides disclosed herein are not limited by a maximum number of wire positions, corresponding electrical contacts, or types of connections that couple each component together.

FIG. 1 depicts an isometric view of a wire guide 100 in accordance with an illustrative embodiment. The wire guide 100 includes a body portion 150 and one or more latching portions 190. In an embodiment, the wire guide 100 is one single piece of molded material. In another embodiment, the wire guide may include a plurality of different pieces of material that are mechanically attached together. Further, the wire guide 100 may be made partly or entirely from an electrically insulative material. The body portion 150 includes a first side surface 180 and a second side surface 181 that each extend from a front surface 170 to a rear surface 171. The first side surface 180 and the second side surface 181 also extend from a top surface 160 to a bottom surface 161. In an embodiment, the body portion 150 is symmetrical such that the top surface 160 mirrors the bottom surface 161, and the first surface 180 mirrors the second surface 181. The front surface 170 extends along a front plane of the body portion 150 and the rear surface 171 extends along a rear plane of the body portion 150, the front and rear planes being parallel.

The body portion 150 includes a first wire opening 101, a second wire opening, 102, a third wire opening 103, and a fourth wire opening 104. In other embodiments, the body portion 150 may have fewer or more wire openings than depicted in FIG. 1. Each wire opening 101, 102, 103, and/or 104 may include a bevel 105 that transitions the respective wire opening to the rear surface 171. The bevel 105 is designed to assist with the initial insertion of a corresponding wire. The first, second, third, and fourth wire openings 101, 102, 103, and 104 extend entirely through the body portion 150. In an embodiment, all of the wire openings 101, 102, 103, or 104 extend from the front surface 170 to the rear surface 171. That is, for example, an insulated wire that is placed into the first wire opening 101 can extend entirely through the first wire opening 101 and protrude from both the front surface 170 and rear surface 171 of the body portion 150.

The latching portion 190 includes a first latching prong 110 and a second latching prong 120. The first latching prong 110 extends from the first surface 180 of the body portion 150 to a first-prong distal end 114. The second latching prong 120 extends from the second surface 181 of the body portion 150 to a second-prong distal end 124. The first and second latching prongs 110 and 120 extend toward and past the front surface 170. The first latching prong 110 includes a first-prong knob 111 that extends from the first-prong distal end 114 toward the second latching prong 120 and toward a centerline axis 199 of the wire guide 100. The second latching prong 120 includes a second-prong knob 121 that extends from the second-prong distal end 124 toward the first latching prong 110 and toward the centerline axis 199 of the wire guide 100. In alternative embodiments, other manners of mechanical latching may be used. For example, in other embodiments, the latching portion 190 may only include one latching prong. In another embodiment, the latching portion 190 may include two, three, four, or more latching prongs. In yet other embodiments, the latching portion 190 may include any other structure that can be used to mechanically secure the wire guide to a corresponding electrical connector.

Figure 2:
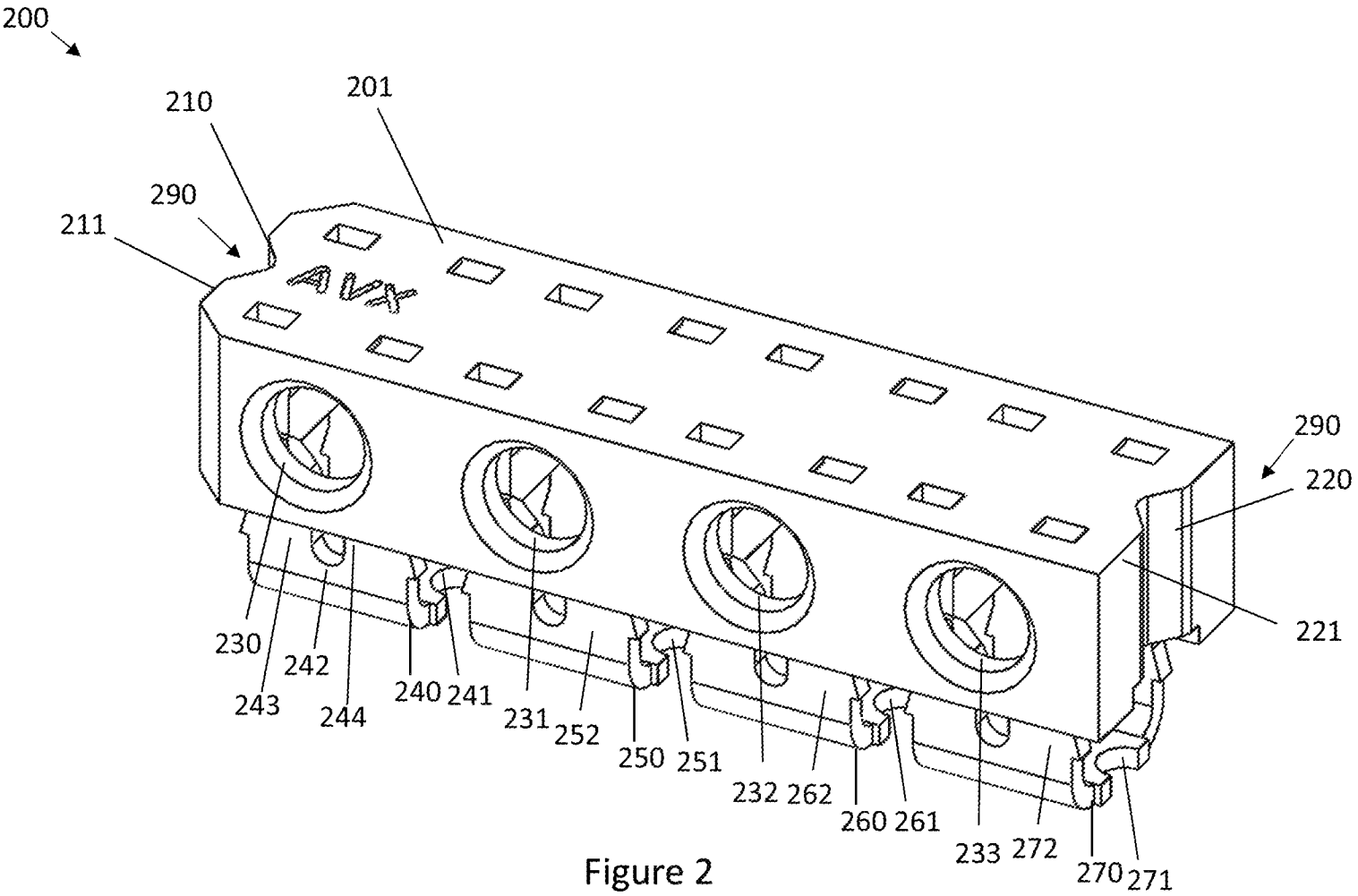
FIG. 2 depicts an isometric view of an insulation displacement contact connector in accordance with an illustrative embodiment.

FIG. 2 depicts an isometric view of an insulation displacement contact connector 200 in accordance with an illustrative embodiment. The insulation displacement contact connector 200 may be used with the wire guide 100 of FIG. 1 to electrically connect one or more electrical wires to an external electrical component. The insulation displacement contact connector 200 includes a housing cap 201, a first electrical contact 240, a second electrical contact 250, a third electrical contact 260, and a fourth electrical contact 270. In alternative embodiments, the insulation displacement contact connector 200 may have fewer or more electrical contacts than depicted in FIG. 2, each contact corresponding to a specific placement in a corresponding housing cap 201. That is, in alternative embodiments, the housing cap 201 may be of any design, shape, and size that houses any number of electrical contacts 240, 250, 260, 270, etc.

The housing cap 201 includes a first wire-alignment opening 230 that corresponds to the first electrical contact 240, a second wire-alignment opening 231 that corresponds to the second electrical contact 250, a third wire-alignment opening 232 that corresponds to the third electrical contact 260, and a fourth wire-alignment opening 233 that corresponds to the fourth electrical contact 270. The housing cap 201 also includes an electrical contact opening (not depicted) for each wire-alignment opening 230, 231, 232, or 233. In alternative embodiments, the insulation displacement contact connector 200 may have fewer or more wire-alignment openings and electrical contact openings than depicted in FIG. 2 depending on the specific desired application for the connector and the number of contacts therein. Each electrical contact opening (not depicted) perpendicularly crosses a corresponding wire-alignment opening 230, 231, 232, 233, etc. In this way, each electrical contact 240, 250, 260, or 270 can be inserted into its respective electrical contact opening (not depicted) and electrically and mechanically connected to a corresponding wire disposed within a corresponding wire-alignment opening 230, 231, 232, 233, etc.

The first electrical contact 240 includes an insulation displacement contact portion 242 and a base portion 241. The second electrical contact 250 includes an insulation displacement contact portion 252 and a base portion 251. The third electrical contact 260 includes an insulation displacement contact portion 262 and a base portion 261. The fourth electrical contact 270 includes an insulation displacement contact portion 272 and a base portion 271. That is, each electrical contact 240, 250, 260, and 270 has a corresponding insulation displacement contact portion 242, 252, 262, and 272 and a base portion 241, 251, 261, and 271. Each base portion 241, 251, 261, and 271 and may be mechanically and electrically attached to a corresponding electrical component (e.g., contact pads on a printed circuit board). Each insulation displacement contact portion 242, 252, 262, and 272 has at least two blades designed to displace insulation from a corresponding insulated wire and electrically and mechanically attach to a conductive core of the corresponding insulated wire. For example, the first electrical contact 240 includes a first blade 243 and a second blade 244 that extend in parallel to each other in a perpendicular direction from the base portion 241. In alternative embodiments, other designs of electrical contacts 240, 250, 260, and 270 may be used.

The housing cap 201 also includes one or more latch-receiving portions 290. In an embodiment, the latch-receiving portion 290 includes a first end notch 210 located on a first surface 211 of the housing cap 201 and a second end notch 220 located on a second surface 221 of the housing cap 201. The first surface 211 is opposite from the second surface 221. In this way, a corresponding wire guide can mechanically secure to the housing cap 201. For example, latching prongs of a corresponding wire guide can mechanically secure to the notches 210 and 220 and create a frictional force that mechanically secures the corresponding wire guide to the housing cap 201. In alternative embodiments, the latch-receiving portion may be any structure that mechanically secures the housing device to a corresponding wire guide.

Figure 3A:
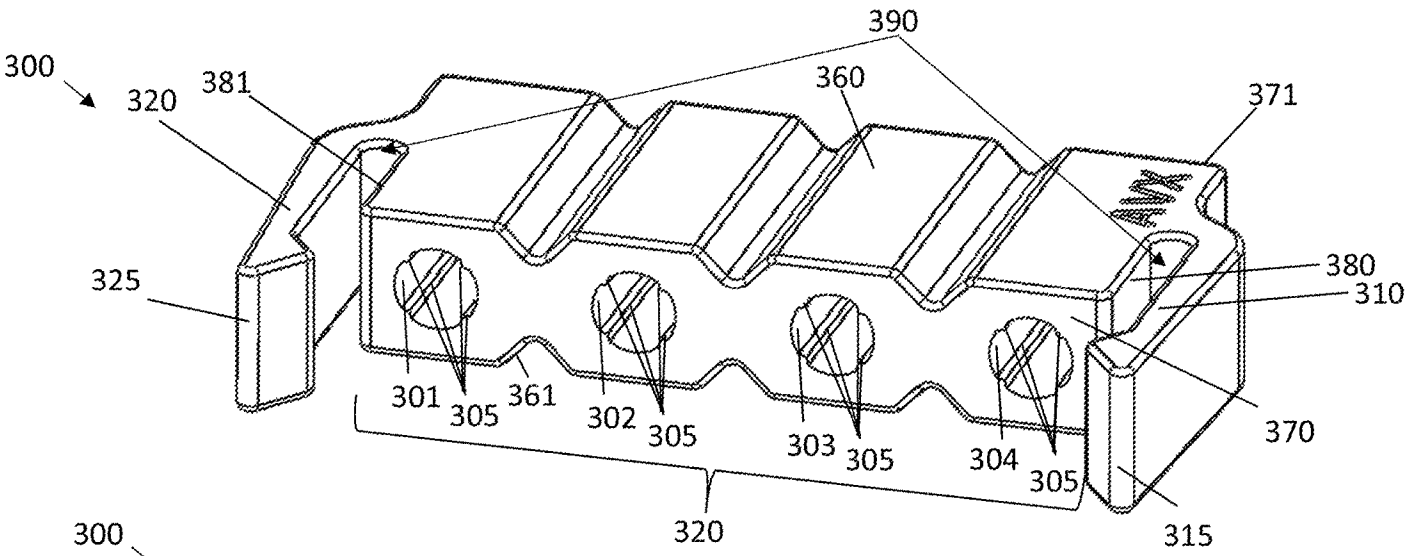
FIG. 3*a* depicts an isometric view of wire guide in accordance with an illustrative embodiment.
Figure 3B:
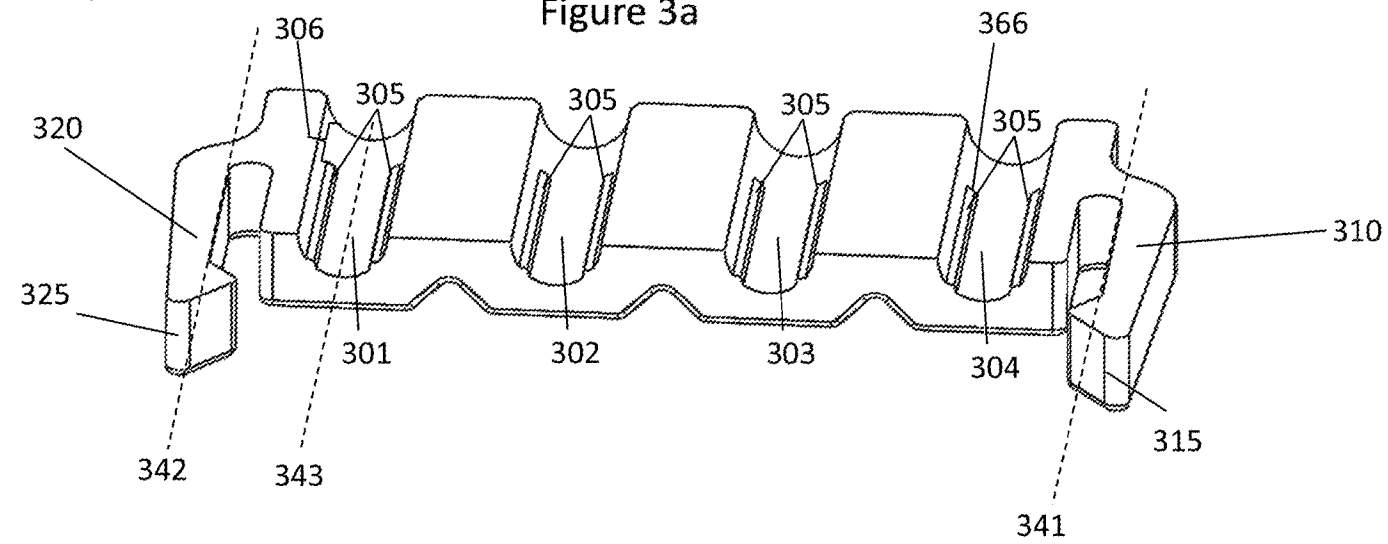
FIG. 3*b* depicts a cross-sectional view of a wire guide in accordance with an illustrative embodiment.

FIG. 3*a* depicts an isometric view of wire guide 300 in accordance with an illustrative embodiment. FIG. 3*b* depicts a cross-sectional view of a wire guide 300 in accordance with an illustrative embodiment. The wire guide 300 includes a body portion 320 and a latching portion 390. The body portion 320 extends from a first surface 380 to a second surface 381, from a front surface 370 to a rear surface 371, and from a top surface 360 to a bottom surface 361. The body portion 320 includes a first wire opening 301, a second wire opening 302, a third wire opening 303, and a fourth wire opening 304. In alternative embodiments, the wire guide 300 may have more or fewer wire openings 301, 302, 303, or 304. Each wire opening may include one or more retention ribs 305. The retention ribs 305 extend from at or near the front surface 370 toward the rear surface 371 on the outer rim of the wire opening. In an embodiment, the retention ribs 305 are positioned within the circular outer rim of each wire opening 301, 302, 303, or 304 at a ninety-degree difference relative to the center of the corresponding wire opening 301, 302, 303, or 304. In an embodiment, the retention ribs 305 extend from the front surface 370 toward the rear surface 371 but end a distance 306 short of reaching the rear surface 371. This configuration allows for easier insertion of a corresponding wire into the rear surface 372 of a wire opening 301, 302, 303, or 304. However, as the corresponding wire is extended entirely through the wire guide 300, the wire is centered and retained by the retention ribs 305. That is, the retention ribs 305 ensure that a corresponding wire is held in place as the wire guide 300 is positioned adjacent to a corresponding device (e.g., an insulation displacement contact connector). The diameter of each of the wire openings 301, 302, 303, or 304 may be different depending upon the application. Similarly, the retention ribs 305 may protrude from the outer rim toward the center axis of each wire opening at different lengths depending upon the given application. Further, the retention ribs 305 may have a transitional portion 366 located on an end of each of the retention ribs 305. The transitional portion 366 may be graduated or beveled to facilitate alignment of a corresponding wire when the corresponding wire is inserted into the wire guide 300. In alternative embodiments, each wire opening 301, 302, 303, or 304 may include more or fewer than the four retention ribs 305. For example, in different applications or designs there may be one, two, three, four, or more ribs in any of the wire openings 301, 302, 303, or 304.

The latching portion 390 includes a first latching prong 310 and a second latching prong 320. In alternative embodiments, the latching portion 390 may be of any design that allows the wire guide 300 to be secured to a corresponding device (e.g., an insulation displacement contact connector). The first latching prong 310 extends from the first surface 380 toward and past the front surface 370 along a first-prong axis 341 to a first-prong distal end 315. The second latching prong 320 extends from the second surface 381 toward and past the front surface 370 along a second-prong axis 342 to a second-prong distal end 325. The first wire opening 301 extends from the front surface 370 entirely through to the rear surface 371 along a centerline wire-axis 343. In an embodiment, the first-prong axis 341, the second-prong 342, and the centerline wire-axis 343 extend in generally the same direction.

Figure 4:
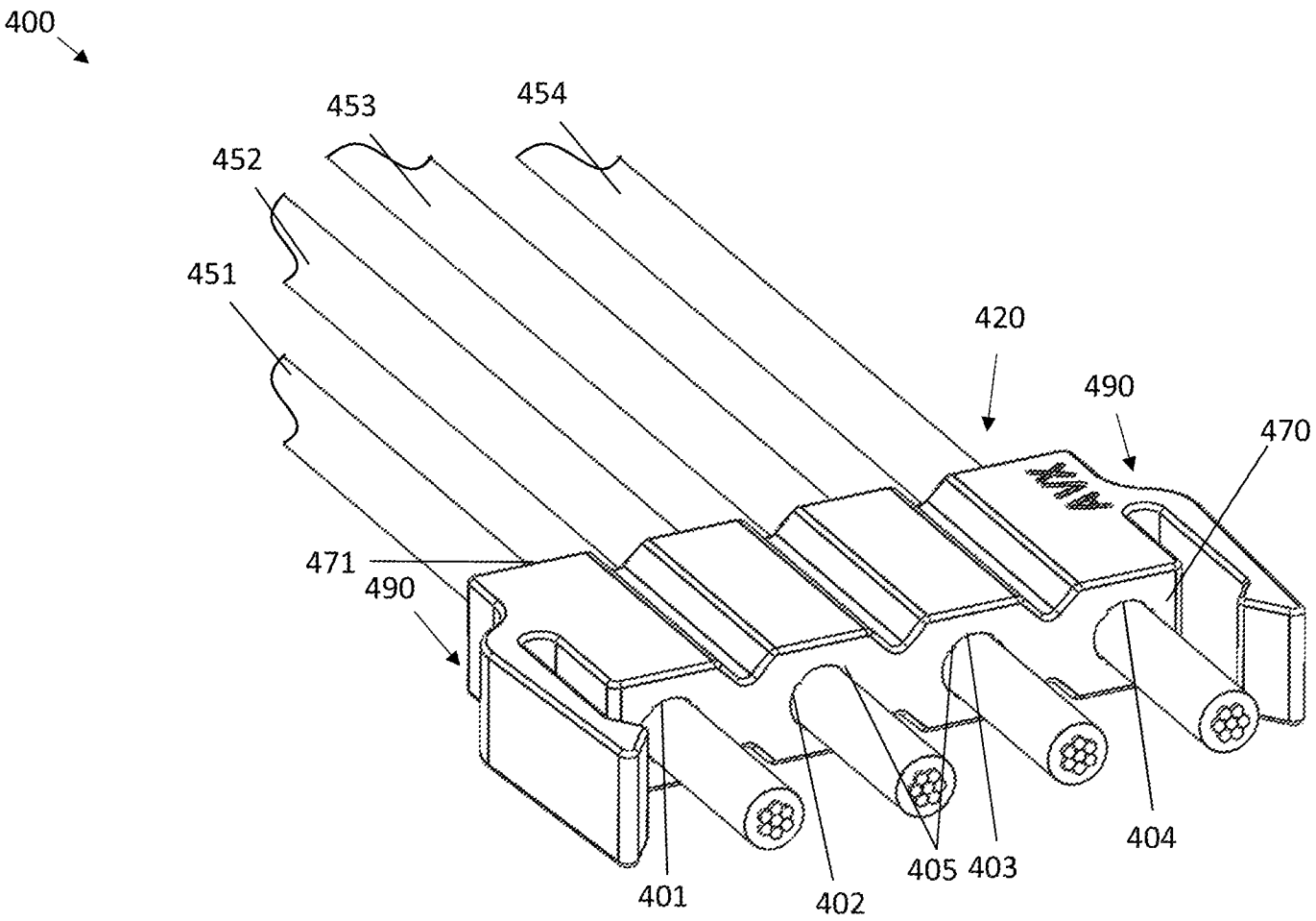
FIG. 4 depicts an isometric view of a wire guide with wires inserted therein in accordance with an illustrative embodiment.

FIG. 4 depicts an isometric view of a wire guide 400 with wires inserted therein in accordance with an illustrative embodiment. The wire guide 400 includes a body portion 420 and a latching portion 490. The body portion 420 includes a first wire opening 401, a second wire opening 402, a third wire opening 403, and a fourth wire opening 404. A first insulated wire 451 has been inserted entirely through the first wire opening 401 and protrudes from the body portion 420 on both a front surface 470 and a rear surface 471. A second insulated wire 452 has been inserted entirely through the second wire opening 402 and protrudes from the body portion 420 on both the front surface 470 and the rear surface 471. A third insulated wire 453 has been inserted entirely through the third wire opening 403 and protrudes from the body portion 420 on both the front surface 470 and the rear surface 471. A fourth insulated wire 454 has been inserted entirely through the third wire opening 404 and protrudes from the body portion 420 on both the front surface 470 and the rear surface 471. Each wire is mechanically secured within a corresponding wire opening 401, 402, 403, or 404 via a frictional force created by retention ribs 405. In this way, the wire guide 400 can be maneuvered while the wire guide 400 holds each wire in a respective desired position relative to the other wires.

Figure 5B:
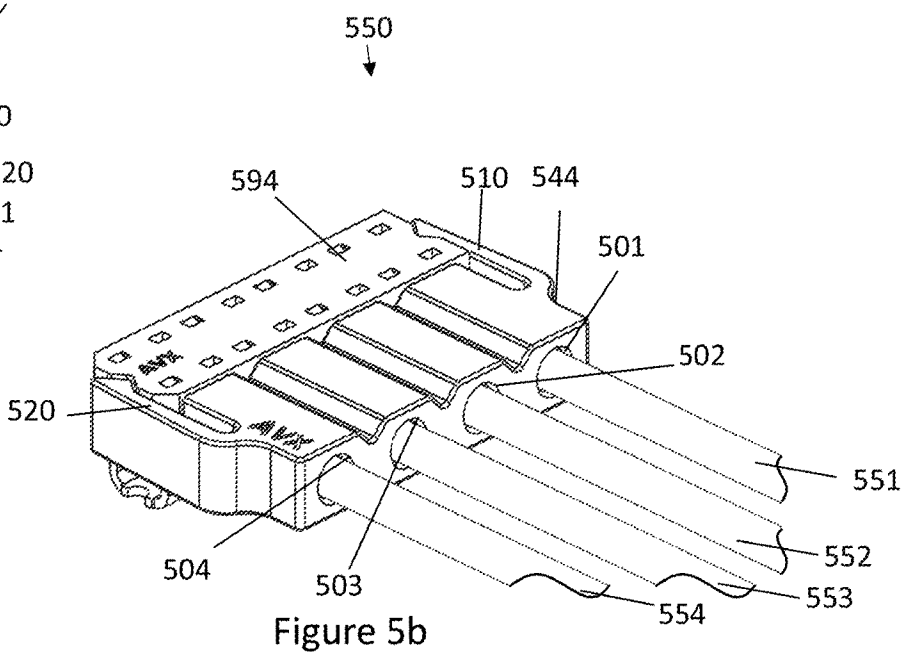
FIG. 5*b* depicts a second isometric view of a wire guide mechanically connected to an insulation displacement contact connector with wires inserted therein in accordance with an illustrative embodiment.
Figure 5A:
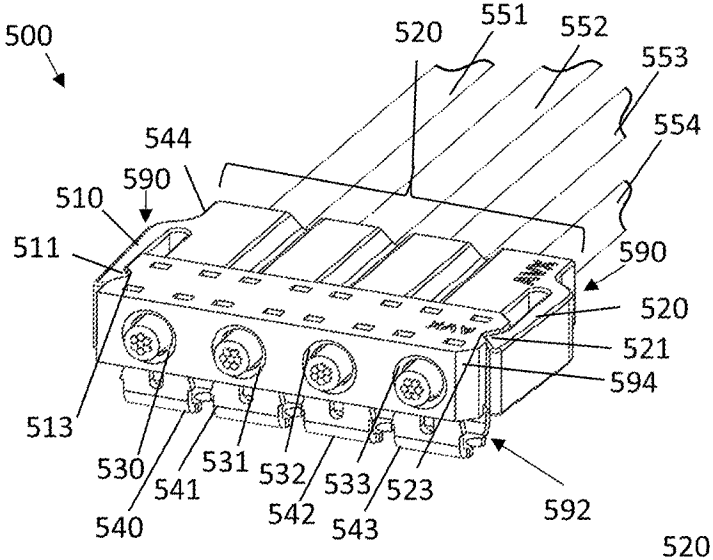
FIG. 5*a* depicts a first isometric view of a wire guide mechanically connected to an insulation displacement contact connector with wires inserted therein in accordance with an illustrative embodiment.

FIG. 5*a* depicts a first isometric view of a wire guide mechanically connected to an insulation displacement contact connector with wires inserted therein 500 in accordance with an illustrative embodiment. FIG. 5*b* depicts a second isometric view of a wire guide mechanically connected to an insulation displacement contact connector with wires inserted therein 550 in accordance with an illustrative embodiment. A wire guide 544 is mechanically attached to an insulated displacement contact connector 592 with a first, second, third, and fourth insulated wire 551, 552, 553, and 554 inserted entirely thought the wire guide 544 and insulation displacement contact. The wire guide includes a body portion 520 and a latching portion 590.

The first, second, third, and fourth wires 551, 552, 553, and 554 were inserted into a respective first, second, third, and fourth wire opening 501, 502, 503, and 504 before the mechanical connection of the wire guide 544 and the insulation displacement contact connector 592 occurred. The wires 551, 552, 553, and 554 were held in position via a frictional force created between the wire openings 501, 502, 503, and 504 and the respective wires (e.g., using retention ribs or other structures designed to create an interference fit) as the wire guide 544 was positioned adjacent to the insulation displacement contact connector 592. The wires 551, 552, 553, and 554 were then guided through respective first, second, third, and fourth wire alignment openings 530, 531, 532, and 533 in the insulation displacement contact connector 592. In this way, the wires 551, 552, 553, and 554 are all in position to be connected to respective first, second, third, and fourth electrical contacts 540, 541, 542, and 543. It is to be appreciated that four wires in this example is only an example and that other embodiments may include one, two, three, four, five, six or more wires, electrical contacts, wire openings, and/or wire-alignment openings.

The latching portion 590 includes a first latching prong 510 and a second latching prong 520. The first latching prong 510 has been positioned such that a first-prong knob 511 of the first latching prong is positioned within a first notch 513 of a housing cap 594 of the insulation displacement contact connector 592. Similarly, the second latching prong 520 has been positioned such that a second-prong knob 521 of the second latching prong 520 is positioned within a second notch 523 of the housing cap 594. This positioning of the first latching prong 510 and the second latching prong 520 mechanically secure the wire guide 544 to the insulation displacement contact connector 592. In this way, the wires 551, 552, 553, and 554 are mechanically secured via a frictional force with their respective wire openings 501, 502, 503, and 504 and the wire guide 544 is mechanically secured to the insulation displacement contact connector 592 via the latching prongs 510 and 520 and respective notches 513 and 523.

Figure 5C:
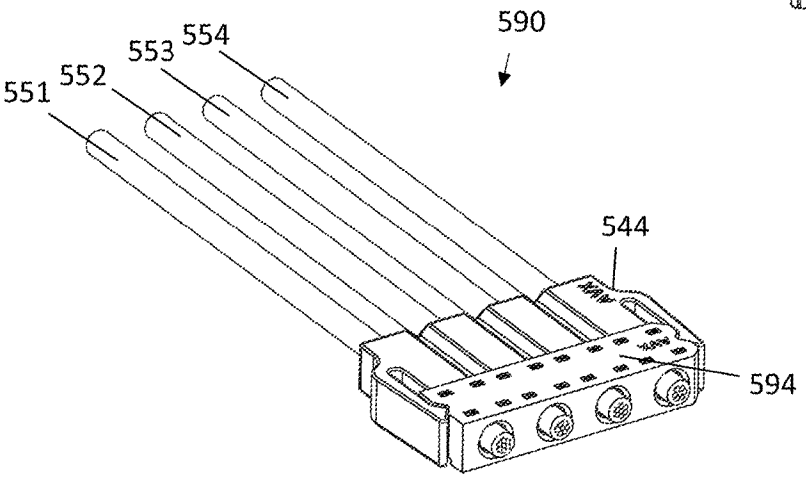
FIG. 5*c* depicts a third isometric view of a wire guide mechanically connected to an insulation displacement contact connector with wires inserted therein in accordance with an illustrative embodiment.

FIG. 5*c* depicts a third isometric view of a wire guide mechanically connected to an insulation displacement contact connector with wires inserted therein 590 in accordance with an illustrative embodiment. FIG. 5*c* depicts, a terminated insulation displacement contact connector 592 with a wire guide 544. That is, the first, second, third, and fourth electrical contacts 540, 541, 542, and 543 were inserted into their respective electrical contact openings (not depicted) of the insulation displacement contact connector 592. Insertion of the first, second, third, and fourth electrical contacts 540, 541, 542, and 543 caused the electrical contacts 540, 541, 542, and 543 to displace insulation from respective wires 551, 552, 553, and 554, thereby creating an electrical and mechanical connection between the electrical contacts 540, 541, 542, and 543 and conductive cores of the respective wires 551, 552, 553, and 554.

Figure 6:
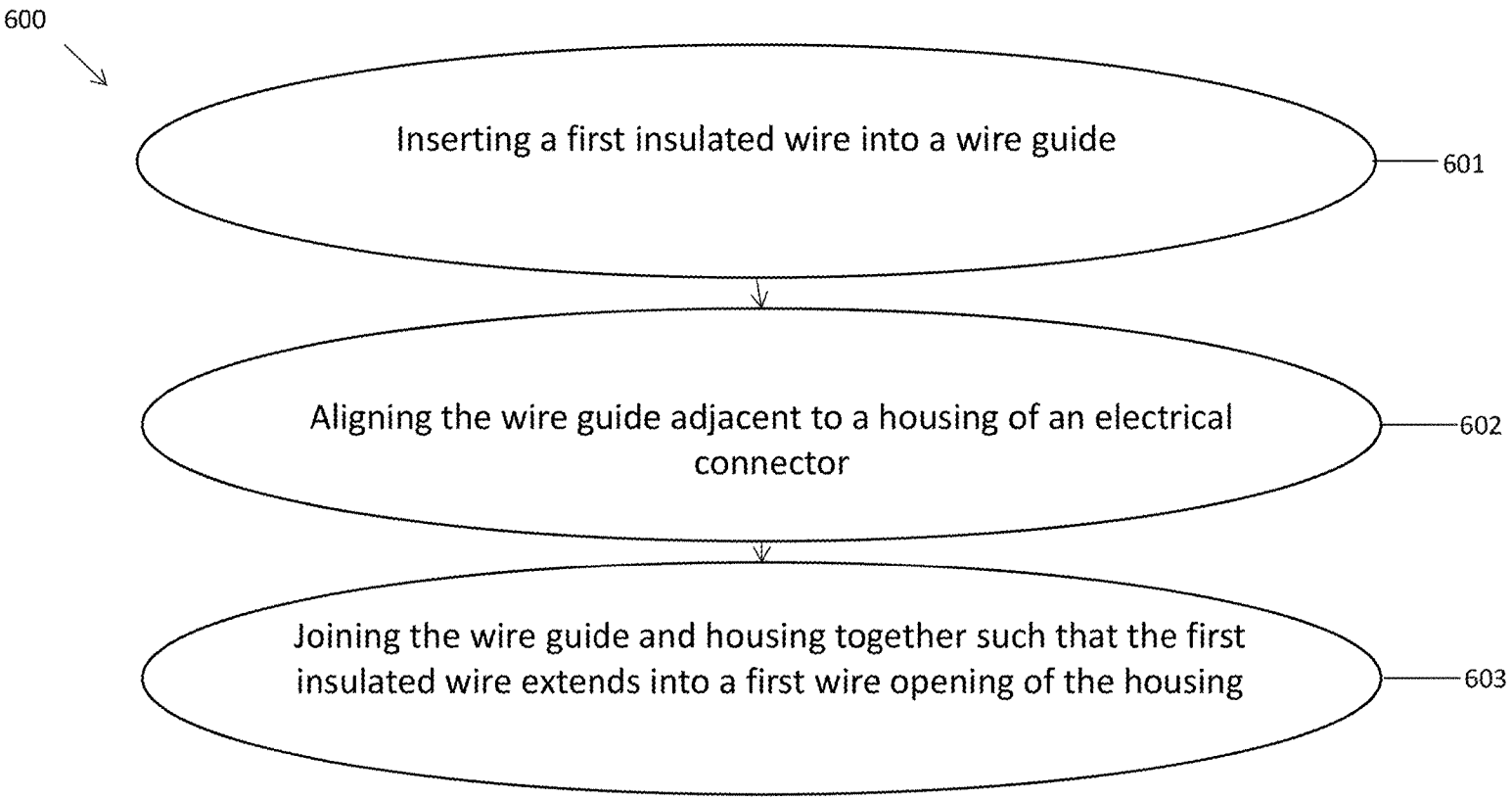
FIG. 6 depicts a flow diagram for a method of use of a wire guide with an insulation displacement contact connector in accordance with an illustrative embodiment.

FIG. 6 depicts a flow diagram for a method of use of a wire guide with an insulation displacement contact connector 600 in accordance with an illustrative embodiment. In an operation 601, a first insulated wire is inserted into a rear surface of a first wire opening of a wire guide and extended entirely through the first wire opening of the wire guide. The insertion of the first insulated wire into the first wire opening can be done in any manner that is convenient for a user. In an embodiment, the first wire opening has a width (e.g., diameter) greater than the first insulated wires. The extension of the first insulated wire entirely through the first wire opening ensures that the first insulated wire extends from the front surface and a rear surface of the wire guide. Further, the extension of the first insulated wire creates a frictional force between the first insulated wire and the first wire opening due to retention ribs located partially through the first wire opening. That is, when the first insulated wire is inserted entirely through the first wire opening, an interference fit is created between the first insulated wire and the retention ribs that protrude from the outer edge of the first wire opening and extend toward a centerline axis of the first wire opening. In an embodiment, the retention ribs do not mechanically touch the first insulated wire until the first insulated wire is extended a distance into the first wire opening. That is, in an embodiment, the retention ribs do not extend along an entirety of the length of the first wire opening. In an embodiment, the retention ribs have a transitional portion along one or both ends of the ribs that facilitates the alignment of the first wire as the first insulated wire is inserted into the fire wire opening. In alternative embodiments, the wire guide may be used with an insulated wire that has a stripped end (e.g., the end of the insulated wire had the insulation removed). That is, in alternative embodiments, the wire guide used with other types of electrical connectors (e.g., a poke-home electrical connector). In an embodiment, operation 601 can be repeated with a second, third, fourth, fifth, sixth or more insulated wire and corresponding wire opening.

In an operation 602, the wire guide is positioned and aligned adjacent to a housing of an insulation displacement contact connector (or other electrical connector to which the wires are to be connected). The alignment of the wire guide ensures that the first (and other) insulated wires are aligned with a first (or other corresponding) wire alignment opening of the housing cap. In this way, all of the insulated wires that were inserted into the wire guide are easily manipulated into correct positions via movement of the wire guide.

In an operation 603, the wire guide is joined with the housing (or other portion of a corresponding electrical connector) such that a latching portion of the wire guide joins and mechanically secures to a latch-receiving portion of the housing. In an embodiment, a first knob of a first latching prong of the latching portion is positioned within a first notch on a first side of the housing and a second knob of a second latching prong of the latching portion is positioned within a second notch on a second side of the housing. The first side of the housing is opposite the second side of the housing. In alternative embodiments, other structures or known methods of mechanically securing devices can be used in order to mechanically secure the wire guide to the housing cap. The joining of the wire guide with the housing ensures that each insulated wire that was inserted into the housing is now aligned within the wire alignment openings with an insulation displacement contact portion of a corresponding electrical contact. The electrical contacts can then be inserted into the housing and cause the electrical contacts to displace insulation from corresponding insulated wires and create a mechanical and electrical contact with the conductive cores of the insulated wires. In an embodiment, a base portion of each electrical contact may already be mechanically and electrically affixed to a contact pad of a printed circuit board. In this way, the insulated wires are electrically connected and mechanically secured to the printed circuit board. In alternative embodiments, the wire guide may be used with other types of electrical connectors (e.g., a poke-home electrical connector). That is, in alternative embodiments, an insulated wire may already have insulation stripped from one of its ends before the insulated wire is inserted and retained by the wire guide. In still other embodiments, some or all of the wires may not have any insulation at all and a corresponding wire opening may be positioned and sized accordingly (e.g., ground wires).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A wire guide comprising:

a body portion comprising a wire opening, wherein the wire opening extends entirely through the body portion, wherein the wire opening comprises:

a circular cross-section; and a plurality of retention ribs extending within the wire opening through the circular cross-section; and a latching portion connected to the body portion, wherein the latching portion comprises a latching prong configured to mechanically engage a corresponding portion of an electrical connector to secure the wire guide to the electrical connector.

2. The wire guide of claim 1, wherein the body portion consists of a single piece of electrically-insulative material.

3. The wire guide of claim 1, wherein the wire opening extends from a first surface of the body portion to a second surface of the body portion.

4. The wire guide of claim 3, wherein the latching portion comprises a second latching prong, wherein the first latching prong extends from a third surface of the body portion to a distal end of the first prong, and the second prong extends from a fourth surface of the body portion to a distal end of the second prong.

5. The wire guide of claim 4, wherein the first latching prong, the second latching prong, and the wire opening extend in generally the same direction.

6. The wire guide of claim 5, wherein the first latching prong and the second latching prong extend from the body portion to a distance past the second surface.

7. The wire guide of claim 5, wherein the first latching prong comprises a knob located on the distal end of the first prong that extends from the distal end of the first prong toward the second latching prong, and the second latching prong comprises a knob located on the distal end of the second prong that extends from the distal end of the second prong toward the first latching prong.

8. The wire guide of claim 3, wherein the at least one wire opening is comprises a diameter, and wherein the diameter is constant as the wire opening extends from the first surface to the second surface.

9. The wire guide of claim 3, wherein the first surface extends along a first plane and the second surface extends along a second plane, and wherein the first plane and the second plane are parallel.

10. A system comprising:

an electrical connector comprising:

a housing comprising a wire alignment opening, an electrical contact opening, and a latch-receiving portion;

an electrical contact comprising a contact portion and a base portion;

wherein the wire alignment opening and the electrical contact opening perpendicularly intersect at an intersection within the housing;

wherein the wire alignment opening is configured to receive an insulated wire and align the insulated wire with the electrical contact opening at the intersection, and the electrical contact opening is configured to receive the contact portion; and a wire guide comprising:

a body portion comprising a wire opening, wherein the wire opening extends entirely through the body portion; and a latching portion connected to the body portion, wherein the latching portion comprises a latching prong configured to mechanically engage the latch-receiving portion of the electrical connector to secure the wire guide to the electrical connector.

11. The system of claim 10, wherein the at least one wire opening is configured to align with the wire alignment opening.

12. The system of claim 10, wherein the latching portion comprises a second latching prong and the latch-receiving portion comprises a first notch on a first side of the housing and a second end notch located on a second side of the housing, wherein the first side is opposite of the second side.

13. A method of guiding a wire comprising:

inserting a first wire entirely through a wire opening in a wire guide;

aligning a first surface of the wire guide with an electrical connector;

manipulating the wire guide to insert the first wire into a first wire opening of the electrical connector; and joining a latching portion of the wire guide to a latch-receiving portion of the electrical connector; and inserting a first electrical contact into the electrical connector, wherein the inserting causes a contact portion of the first electrical contact to electrically and mechanically connect to the first wire.

14. The method of claim 13 further comprising:

inserting a second wire entirely through a second wire opening of the wire guide; and manipulating the wire guide to insert the second wire opening of the electrical connector.

15. The method of claim 13, further comprising:

inserting a second electrical contact into the electrical connector, wherein the inserting of the second electrical contact causes a contact portion of the second electrical contact to electrically and mechanically connect to the second wire.

16. The method of claim 13, wherein the joining the latching portion and the latch-receiving portion comprises:

aligning a first latching prong with a first edge of a first side of the electrical connector;

aligning a second latching prong with a second edge of a second side of the electrical connector; and joining the electrical connector and the wire guide together.

17. The method of claim 16, wherein joining the housing and the wire guide together causes a first knob of the first latching prong to enter a first notch on the first side on the electrical connector and causes a second knob of the second latching prong to enter a second notch on the second side of the electrical connector, and wherein the first side is opposite from the second side.

* * * * *